United States Patent [19]

Kubota

[11] Patent Number: 4,998,229

[45] Date of Patent: Mar. 5, 1991

[54] PROGRAMMABLE WORLD TIMEPIECE WITH AUTOMATIC RESTORATION MODE

[75] Inventor: Maki Kubota, Tokyo, Japan

[73] Assignee: Seikosha Co., Ltd., Japan

[21] Appl. No.: 285,003

[22] Filed: Dec. 15, 1988

[30] Foreign Application Priority Data

Dec. 21, 1987 [JP] Japan ..... 62-323582
Dec. 21, 1987 [JP] Japan ..... 62-323583

[51] Int. Cl.[5] ..... G04B 19/22; G04B 25/00

[52] U.S. Cl. ..... 368/21; 368/22; 368/223

[58] Field of Search ..... 368/21, 22, 23, 24

[56] References Cited

U.S. PATENT DOCUMENTS 4,274,151 6/1981 Kamiwaki ..... 368/22
4,435,086 3/1984 Kato ..... 368/22
4,479,722 10/1984 Salah ..... 368/22
4,681,460 7/1987 Nishimura ..... 368/22
4,779,247 10/1988 Uchida ..... 368/22

*Primary Examiner*—Bernard Roskoski
*Attorney, Agent, or Firm*—Bruce L. Adams; Van C. Wilks

[57] ABSTRACT

A programmable world timepiece features the ability to audibly announce the date and time of a number of cities around the world. The timepiece also allows the user to easily change a home or present city date and time without having to use multiple switches or push buttons. The timepiece also provides for the automatic restoration of a home city time, date and identification number to a display without having to select or use additional indicators within 0.5 seconds.

12 Claims, 4 Drawing Sheets

PROGRAMMABLE WORLD TIMEPIECE WITH AUTOMATIC RESTORATION MODE

DETAILED DESCRIPTION OF THE INVENTION

1. Industrial Field of the Invention

The present invention relates to a world timepiece.

2. Prior Art

A prior art world timepiece includes that in which time of an arbitrary city can be displayed selectively on a common display unit by operating a selector switch provided at a plurality of main cities. The time of the city finally selected can then be displayed continuously on the display unit.

Problem to be Solved by the Invention

In the prior art world timepiece while, for example, the timepiece is used in Tokyo, there may be a case where time of another city is invoked once, then an operation for resetting the time of Tokyo is required. If such an operation is omitted, then the time of another city is left displayed, and thus the time may be frequently mistaken for that of Tokyo.

Further, in case the time is to be identified in an dark, a selector switch for the arbitrary city must be operated by a light.

A first object of the invention is to enable identification of home city time at all times, a second object of the invention is to enable the home city be set as to an arbitrary city without adding another switch, and a third object is to make the home city time simply indentifiable even in the dark without adding another switch.

Means to Solve the Problem

The invention comprises a storage circuit for storing an arbitrary city as a home city by operating the specific selector switch thereof, and a timer circuit for counting a period during which time, of a city other than the home city, can be displayed on a display unit, and then changing the display to that of the home city time upon counting a desired period. Thus the arbitrary city can be set as a home city; the home city time bring normally displayed.

1 . . . selector switch, 4 . . . display unit, 5 . . . storage circuit, 6 . . . timer circuit, 12 . . . information circuit.

EMBODIMENT

The invention will now be described with reference to the accompanying drawings representing one embodiment thereof.

Figure 1:
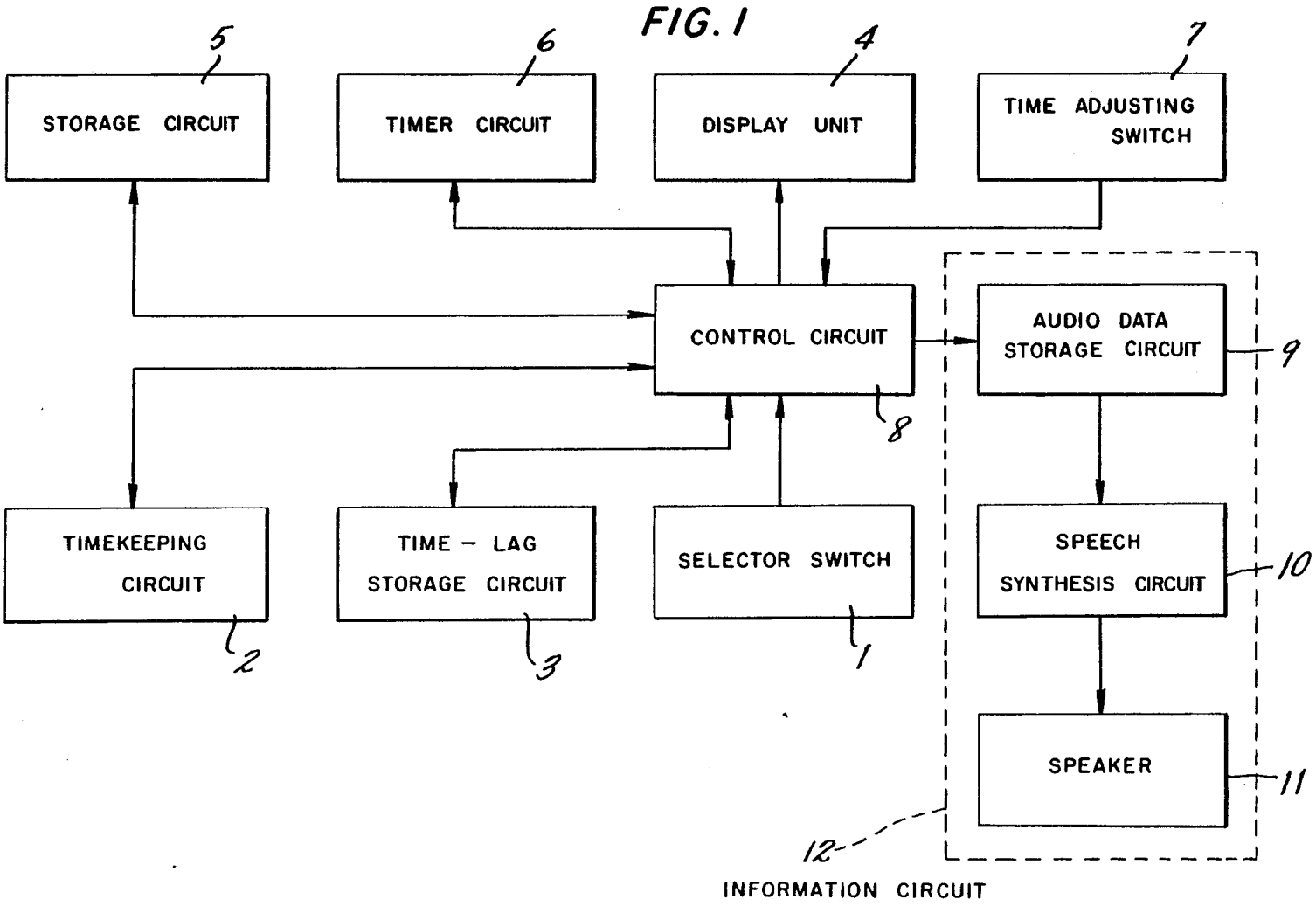
FIG. 1 is a block diagram representing one embodiment of the invention.

In FIG. 1, 1 denotes a selector switching means or selector switch means provided at a plurality of main cities having a time-lag, functioning as to inform the name, date and time of each city; 2 denotes a timekeeping circuit for keeping the time of a reference city, and 3 denotes a time-lag storage circuit for storing a time-lag between the reference city and each main city. A reference numeral 4 denotes a means for selectively displaying, a display means or display unit for displaying the time of each main city selectively by operating the selector switch 1; 5 denotes a storage circuit or storage means for storing a specific city chosen from one of the main cities as a home city; 6 denotes a timer circuit timer means or display time means for counting a period during which time of a city other than the home city is displayed on the display unit 4, and which generates an output upon counting the desired, 7 denotes a time adjusting means or time adjusting switch; and 8 denotes a control circuit or means for controlling operating with various controls on signals from the selector switch 1, the timer circuit 6 and the time adjusting switch 7. Reference numeral 9 denotes an audio data storage circuit for storing audio data for announcing in an audio mode the name, date and time of each main city; 10 denotes a speech synthesis circuit for generating a speech signal when a signal from the audio data storage circuit 9 is received, 11 denotes a speaker means or speaker for generating speech when a signal from the speech synthesis circuit 10 is received constituting an information circuit or speech generating means 12. Numerals 2, 3, 5, 4 and 8 all being realized as timekeeping means.

Figure 2:
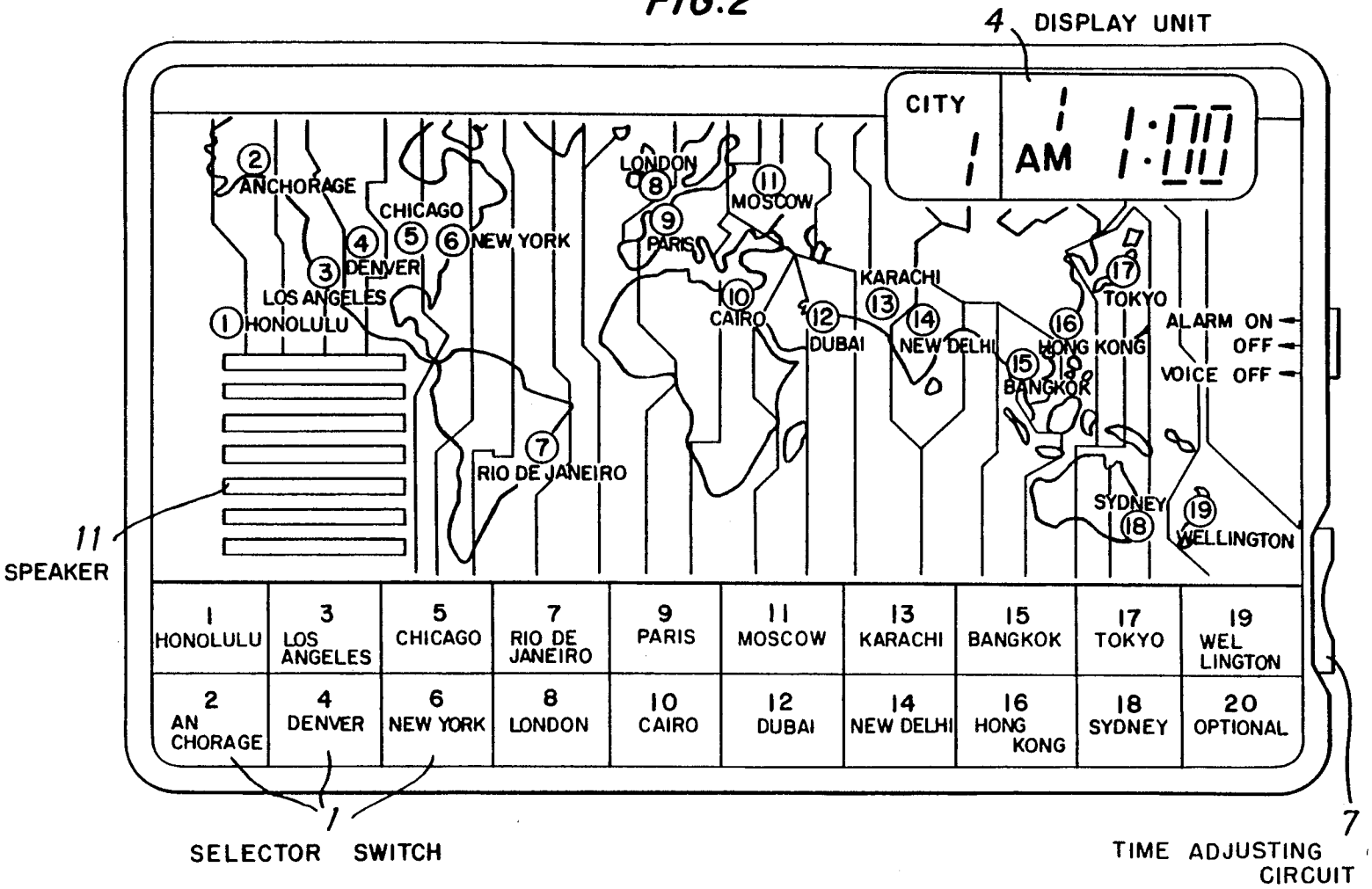
FIG. 2 is a front view exemplifying the main part of FIG. 1.

FIG. 2 exemplifies the selector switch 1, the display unit 4, means for outputting or time adjusting switch 7 and the speaker means 11, of which the selector switch 1 is a touch activated type, and the display unit 4 uses a liquid crystal panel thereon.

Figure 3:
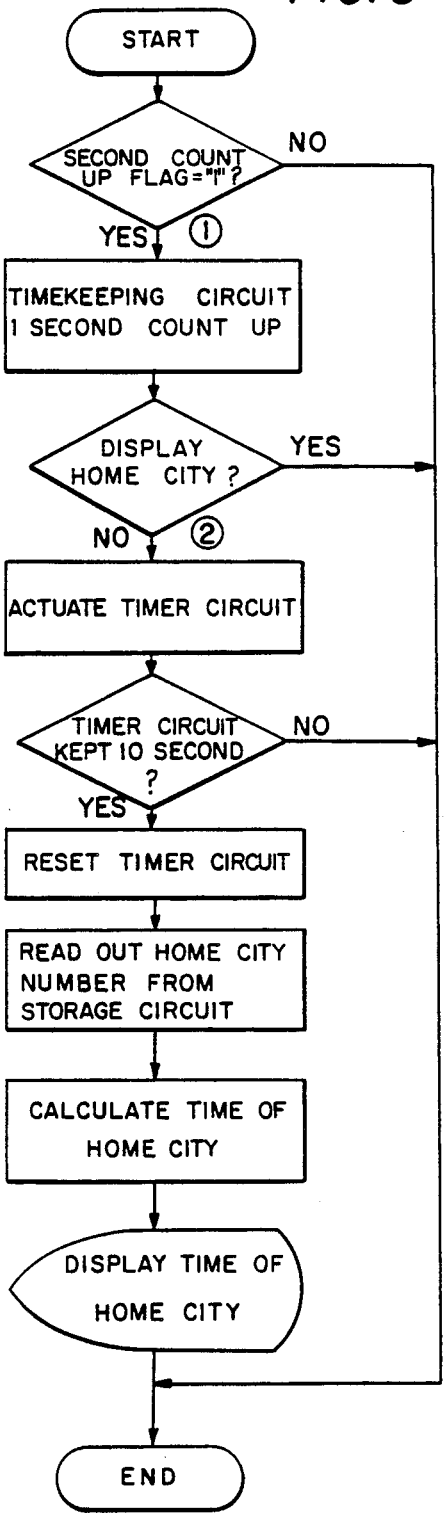
FIG. 3, FIG. 4 and FIG. 5 are flowcharts for illustrating a circuit operation of FIG. 1.

Referring first to the flowchart of FIG. 3, the timekeeping circuit 2 keeps the time of a reference city at every second. Then, the time of a home city stored in the storage circuit 5 is displayed normally on the display unit 4 (routine ①). When a display on the display unit 4 is changed to a time other than the home city time, the timer circuit 6 is actuated, and a signal is generated to the control circuit 8 upon counting a predetermined period. A signal for resetting the timer circuit 6 is generated in the control circuit 8 according to a signal from the timer circuit 6, thus the timer circuit 6 is reset and a home city number stored in the storage circuit 5 is ready at the same time. A time-lag corresponding to the number is read out of the time-lag storage circuit 3. The date and time of the home city are calculated from the time-lag and the time kept by the timekeeping circuit 2. The date and time are then displayed on the display unit 4 together with the home city number (routine ②).

According to the operation described above, the display on the display unit 4 which is changed once to one other than the home city time stored in the storage circuit 5, will be automatically restored to that of the home city time after a predetermined period.

Figure 4:
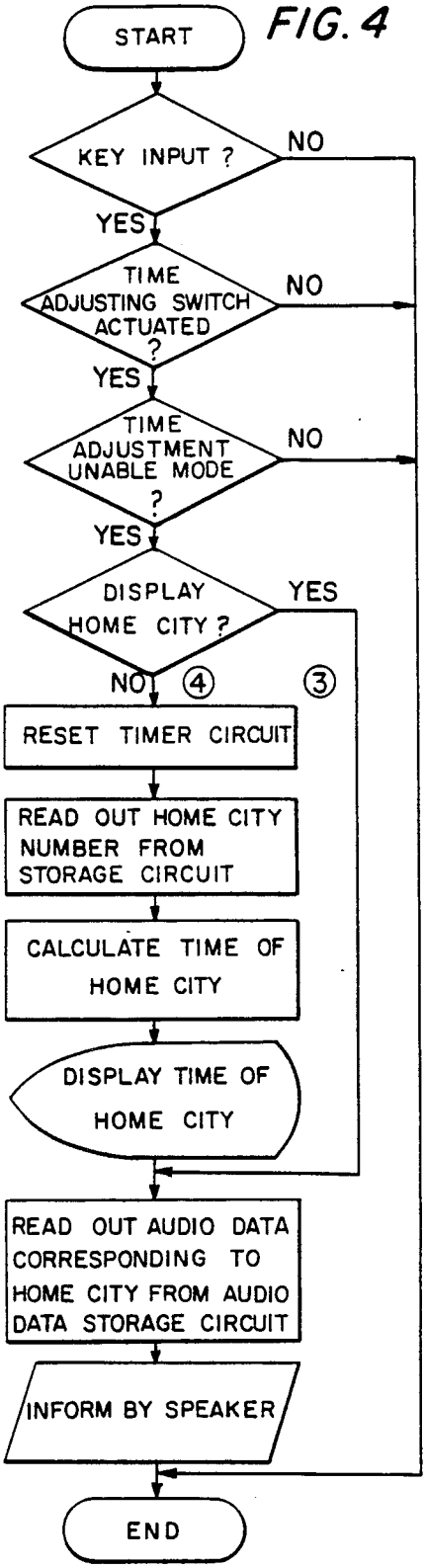

Described next is an operation for announcing the time in an audio mode during a time adjustment disenable mode with reference to the flowchart of FIG. 4. During a time adjustment disenable mode, so caused by a time adjusting lock switch or time adjustment disable means (not indicated), if the time adjusting switch 7 is operated when the home city time is displayyed on the display unit a speech control signal is generated from the time adjusting switch or information activating means to the control circuit 8 which in turn sends a control signal to the audio data storage circuit 9, and an audio data for announcing the name, date and time of the home city is read and generated from the audio data storage circuit 9. A speech signal is generated from the speech synthesis circuit 10 according to the audio data, and the speaker 11 is actuated to announce the name, date and time of the home city according to the speech signal (routine ③).

Then, during the time adjustment disenable mode, if the time adjusting switch 7 is operated when the time of a city other than the home city is displayed on the display unit 4, the timer circuit 6 is reset by the control circuit 8 and the home city number is read out of the storage circuit 5 at the same time, and a time-lag corresponding to the number is read out of the time-lag storage circuit 3. The date and time of the home city are then calculated from the time-lag and the time kept by the timekeeping circuit 2, and then they are displayed on the display unit 4 together with the home city number. A signal is also generated concurrently from the control circuit 8 to the audio data storage circuit 9. The audio data for announcing the name, date and time of the home city is read and generated according to the signal. The speech signal is generated from the speech synthesis circuit 10 according to the audio data, and the speaker 11 is actuated to announce the name, date and time of the home city according to the speech signal (routine ④).

According to the operation described above, by operating the time adjusting switchh 7 in the time adjustment disenable mode, the home city time is displayed on the display unit 4 and the information circuit 12 is actuated to inform thereon.

Figure 5:
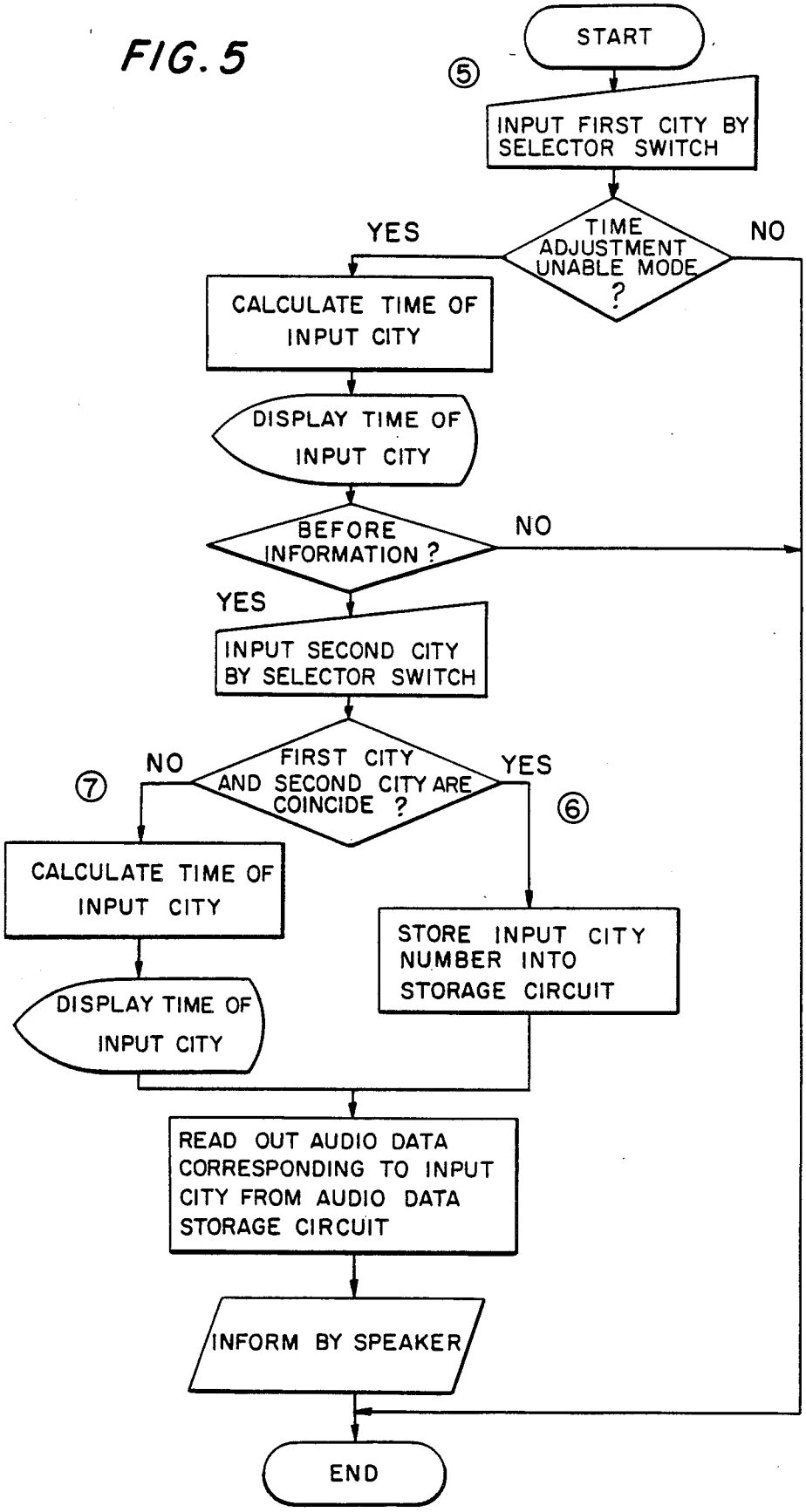

Next, how to select and set a home city will be described according to the flowchart of FIG. 5. In the time adjustment disenable mode, when the selector switch 1 for a desired city (hereinafter called first city), is tenched the time-lag corresponding to the number of the first city is read oput of the time-lag storage circuit 3 in the control circuit 8, the date and time of the first city are then calculated from the time-lag and from the time kept by the timekeeping circuit 2, and then they are displayed on the display unit 4 together with the first city number (routine ⑤). After the display, if no other operation is completed then the name date and time of the first city are audibly announced 0.5 seconds later by the information circuit 12. Thus an infirming means allows for the visual and audio presentation of the time, number and date of the main cities. However, if the selector switch 1 for a second, desired city (hereinafter called second city) is operated before these are audibly announced, the numbers of the first city and second city are compared in the control circuit 8, and if both the two are coincident, the city number is stored in the storage circuit 5 as home city. The time-lag corresponding to the city number is read concurrently from the time-lag storage circuit 3. The date and time of the home city are calculated from the time-lag and the time kept by the timekeeping circuit 2. A signal is generated to the audio data storage circuit 9 for informing the name, date and time of the home city. These are read and generated according to the signal, the speech signal being generated from the speech synthesis circuit 10 according to the audio data. Thus, the speaker 11 is actuated to audibly announce inform the name, date and time of the home city according to the speech signal (routine ⑥).

In case, though where the first city and the second city are not coincident, a time-lag corresponding to the second city is ready out of the time-lag storage circuit 3. The date and time of the second city are calculated from the time-lag and the time kept by the timekeeping circuit 2, and then they are displayed on the display unit 4 together with the second city number. A signal is also generated concurrently to the audio data storage circuit 9 from the control circuit 8. The audio data for audibly announcing the name, date and time of the second city is read and generated according to the signal. The speech signal is generated from the speech synthesis circuit 10 according to the audio data, and thus the speaker 11 is actuated to audibly announce the name, date and time of the second city according to the speech signal (routine ⑦).

According to the operation described above, the selector switch 1 for the desired city is must be operated twice before the name, date and time of the city are audibly announced thereby storing the city in the storage circuit as home city.

If, however, in the above-described embodiment a plurality of selector switches are operated representing a plurality of main cities, each main city will be selected to be successively displayed successively whenever it is operated.

Effect of the Invention

According to the invention, a time of a city other than that of the home city is displayed and then changed back to that of the home city time after a predetermined period, therefore, another switch is not particularly required and the home city time can be identified at all times. Accordingly, the time of a city other than the home city so displayed will never be mistaken for the home city time.

Further, an arbitrary city can be set as the home city by operating the selector switch. Therefore if, for example the resident city is set once as a home city, then the resident city time can be identified at a glance as in the case of ordinary timepiece without operating the selector switch in each occasion.

Still further, from informing in an audio mode on the home city time through operating the time adjusting switch in a time adjustment unable mode, the home city time can simply be identified auditorily without adding a special switch therefor. Accordingly, in a world timepiece provided with many selector switches, users are kept from a trouble to search a selector switch of the city set as home city, and it is serviceable particularly in the dark.

What is claimed is:

1. A world timepiece for informing the time in an audio mode, comprising:

timekeeping means for keeping the time of a home city and of main cities;

selector switching means having a plurality of switches, the switches corresponding to respective main cities having a time-lag therebetween informing means for selectively informing the time of one of said main cities in audio and visual modes according to the operation of one of the switches;

storage means for storing a specific city out of said main cities as a home city;

timer means for counting a period during which the time of a city other than said home city is visually informed by said informing means and generating an output upon counting a desired time;

control means responsive to said output of said timer means for controlling said informing means to cause the same to visually inform the time of said home city;

time adjusting means operably when enabled for adjusting the time of said timekeeping means;

time adjustment disenable means for disenabling said time adjusting means; and information activating means for activating said informing means to cause the same to inform the time of said home city in an audio mode by operating said time adjusting means when time adjustment is disenabled by said time adjustment disenable means.

2. A world timepiece having the function to select a home city, comprising:

selector switching means having a plurality of switches, the switches corresponding to respective main cities having a time lag therebetween;

display means for selectively displaying the time of one of said main cities according to the operation of one of the switches;

audio output means for informing the time of the selected one of said main cities a desired time after the operation of said one of the switches;

storage means for storing an arbitrary city out of said main cities as a home city;

timer means for counting a period during which the time of a city other than said home city is displayed by said display means and generating an output upon counting a desired time, thereby displaying the time of said home city by said display means; and storage control means for storing a specific one of said main cities in said storage means as the home city when the switch corresponding with said specific one of said main cities is operated twice with said desired time.

3. A programmable world timepiece operable in an automatic restoration mode comprising:

timekeeping means for keeping the time of a home city and of main cities and for selectively displaying the time of said home city or one of same main cities and for producing control signals for controlling the operation of the timepiece;

speech generating means for generating audio speech upon receiving a control signal from said timekeeping means, said audio speech representing the time of one of said main cities or said home city;

time adjusting means operable when enabled for adjusting the time displayed by said timekeeping means and operable when disenabled for sending a speech control signal to said timekeeping means to initiate the sending of the control signal to said speech generating means;

time adjustment disenable means for disenabling said time adjusting means whereby said time adjusting means then sends the speech control signal to said timekeeping means;

selector switch means for selecting any one of said main cities to be displayed by said timekeeping means and for setting a new home city when said time adjusting means is disenabled; and display time means for timing the display of the selected one of said main cities by said timekeeping means for a predetermined time after which said home city is automatically displayed by said timekeeping means.

4. A programmable world timepiece operable in an automatic restoration mode according to claim 3; wherein said timekeeping means comprises a timekeeping circuit for keeping a time of a reference city, a time-lag storage circuit for storing times between said reference city and said main cities whereby the addition of the time of the reference city with a time between said reference city and one of said main cities equals the present time of one of said main cities, means for selectively displaying the time of said home city or one of said main cities, means for controlling the operation of the timepiece and a storage circuit for storing one of said main cities as said home city.

5. A programmable world timepiece operable in an automatic restoration mode according to claim 4; wherein said means for selectively displaying the time of said home city or one of said main cities comprises a display unit.

6. A programmable world timepiece operable in an automatic restoration mode according to claim 4; wherein said means for controlling the operation of the timepiece comprises a control circuit.

7. A programmable world timepiece operable in an automatic restoration mode according to claim 3; wherein said timekeeping means selectively displays a number of said home city or one of said main cities.

8. A programmable world timepiece operable in an automatic restoration mode according to claim 3; wherein said timekeeping means selectively displays a date of said home city or one of said main cities.

9. A programmable world timepiece operable in an automatic restoration mode according to claim 3; wherein said audio speech represents a number of said home city or of one of said main cities.

10. A programmable world timepiece operable in an automatic restoration mode according to claim 3; wherein said audio speech represents a date of said home city or of one of said main cities.

11. A programmable world timepiece operable in an automatic restoration mode according to claim 3; wherein said speech generating means comprises an audio data storage circuit for storing audio data, said audio data being used to generate the audio speech, a speech synthesis circuit for generating speech signals using said audio data and means for outputting the audio speech.

12. A programmable world timepiece operable in an automatic restoration mode according to claim 11; wherein said means for outputting comprises speaker means for outputting the audio speech.

* * * * *